US009380375B2

(12) United States Patent
Yang

(10) Patent No.: US 9,380,375 B2
(45) Date of Patent: Jun. 28, 2016

(54) EARPHONE WITH SPEAKER RING

(71) Applicant: M2 Technology, Inc., New Taipei (TW)

(72) Inventor: Chun-Yao Yang, New Taipei (TW)

(73) Assignee: M2 Technology, Inc., New Taipei (TW)

( * ) Notice: Subject to any disclaimer, the term of this patent is extended or adjusted under 35 U.S.C. 154(b) by 0 days.

(21) Appl. No.: 14/557,599

(22) Filed: Dec. 2, 2014

(65) Prior Publication Data

US 2016/0157009 A1 Jun. 2, 2016

(51) Int. Cl.
*H04R 1/10* (2006.01)

(52) U.S. Cl.
CPC ..... *H04R 1/1091* (2013.01)

(58) Field of Classification Search
CPC ..... H04R 2225/023; H04R 2225/025; H04R 1/10; H04R 2205/022; H04R 2460/13; H04R 1/1016; H04R 1/105
USPC ..... 381/328, 370, 380–381
See application file for complete search history.

(56) References Cited

U.S. PATENT DOCUMENTS 2,808,468 A * 10/1957 Knauert ..... H04R 11/06 381/328
3,985,960 A * 10/1976 Wallace, Jr. ..... H04R 1/1016 381/380
4,991,439 A * 2/1991 Betts ..... A01M 1/026 73/587
2003/0152244 A1* 8/2003 Dobras ..... H04R 1/1058 381/381

* cited by examiner

*Primary Examiner* — Suhan Ni
(74) *Attorney, Agent, or Firm* — Alan D. Kamrath; Kamrath IP Lawfirm, P.A.

(57) ABSTRACT

An earphone with a speaker ring contains: a sound guiding tube, a speaker, and a body. The sound guiding tube is connected with the body, and the speaker is disposed in the sound guiding tube. The speaker has a first O ring fitted on a front end thereof and a second O ring fitted on a rear end thereof, and the first O ring and the second O ring are defined between the speaker and the sound guiding tube. Thereby, the first O ring, the second O ring, and the third O ring are arranged between the speaker and the sound guiding tube to reduce the resistance between the speaker and the sound guiding tube, thus increasing tone quality.

8 Claims, 10 Drawing Sheets

EARPHONE WITH SPEAKER RING

BACKGROUND OF THE INVENTION

1. Field of the Invention

The present invention relates to an earphone and, more particularly, to an earphone with a speaker ring.

2. Description of the Prior Art

A conventional earphone is portable conveniently in daily life and contains a sound guiding tube, a body, and a speaker. The speaker is fixed in and contacts with the sound guiding tube. In use, the speaker causes resonance with the sound guiding tube to reduce tone quality.

The present invention has arisen to mitigate and/or obviate the afore-described disadvantages.

SUMMARY OF THE INVENTION

The primary objective of the present invention is to provide an earphone with a speaker ring in which at least one O ring is fixed in a sound guiding tube to reduce resonance between the speaker and the sound guiding tube.

To obtain the above-mentioned objectives, an earphone with a speaker ring provided by the present invention contains: a sound guiding tube, a speaker, and a body. The sound guiding tube is connected with the body, and the speaker is disposed in the sound guiding tube. The speaker has a first O ring fitted on a front end thereof and a second O ring fitted on a rear end thereof, and the first O ring and the second O ring are defined between the speaker and the sound guiding tube. Thereby, the first O ring, the second O ring, and the third O ring are arranged between the speaker and the sound guiding tube to reduce the resistance between the speaker and the sound guiding tube, thus increasing tone quality.

Preferably, an earphone further contains a third O ring fitted on the rear end of the speaker and inside the second O ring.

Preferably, a diameter of a cross section of the third O ring is less than that of the second O ring.

Preferably, a diameter of each of the first O ring and the second O ring is 7 mm, and a diameter of a cross section of each of the first O ring and the second O ring is 1.5 mm.

Preferably, a diameter of the third O ring is 7 mm, and a diameter of a cross section of the third O ring is 1.1 mm.

Preferably, the body includes at least one air orifice defined on a rear cap thereof.

Preferably, each of the at least one air orifice has a slot defined thereon.

Preferably, the nameplate groove has a nameplate attached outside the nameplate groove.

Preferably, the slot has a nameplate groove arranged therearound, and the nameplate groove has a nameplate accommodated therein.

Preferably, a number of the at least one air hole is one or two.

Thereby, the first O ring, the second O ring, and the third O ring are arranged between the speaker and the sound guiding tube to reduce the resistance between the speaker and the sound guiding tube, thus increasing tone quality.

DETAILED DESCRIPTION OF THE PREFERRED EMBODIMENTS

Figure 1:
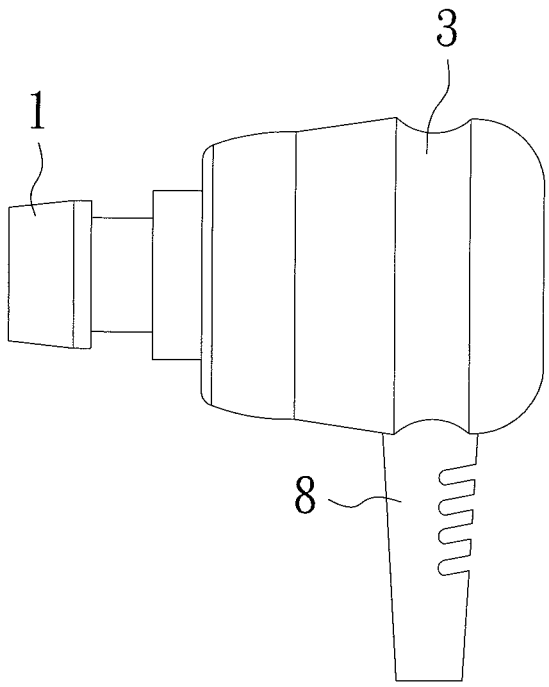
FIG. 1 is a front plan view showing the assembly of an earphone with a speaker ring according to the present invention.
Figure 2:
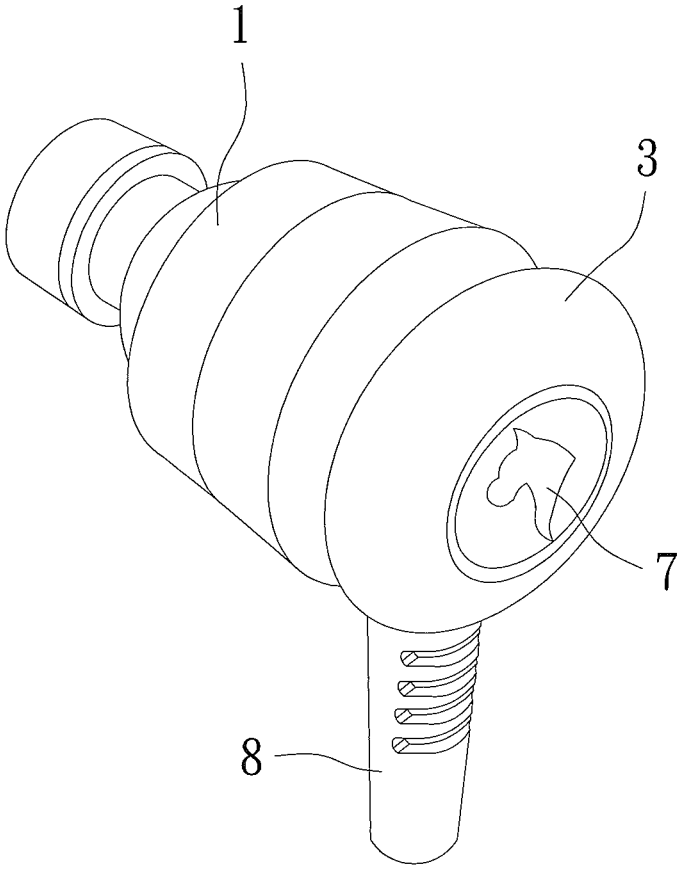
FIG. 2 is a perspective view showing the assembly of the earphone with the speaker ring according to the present invention.
Figure 3:
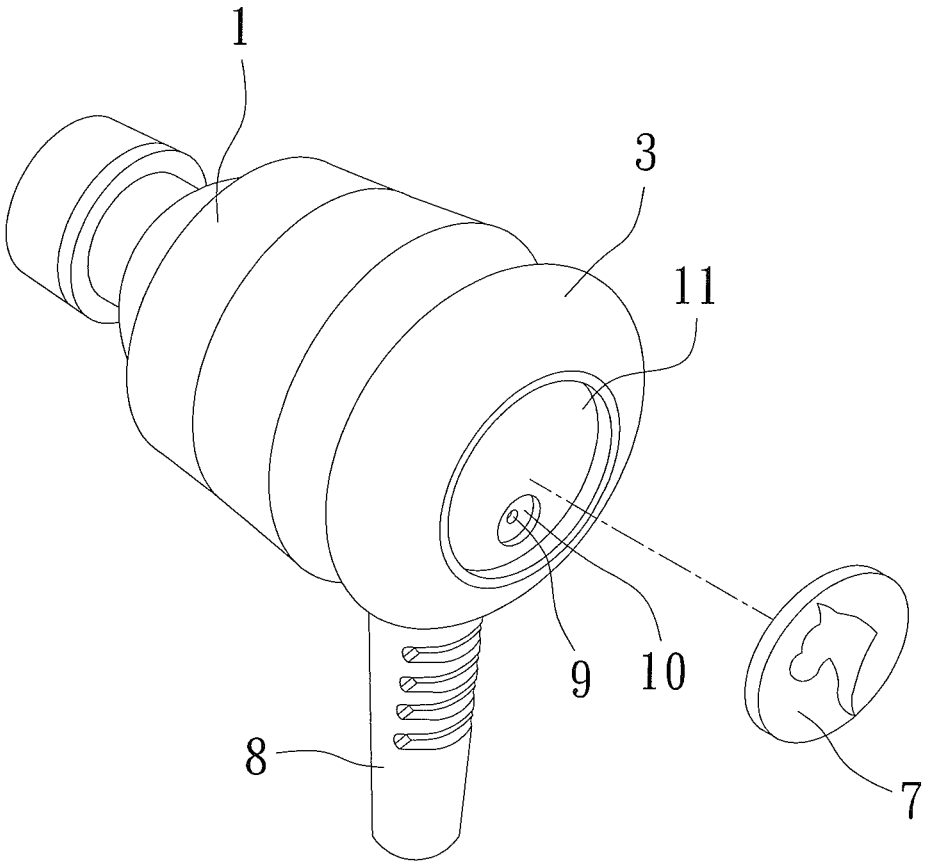
FIG. 3 is a perspective view showing the assembly of a part of the earphone with the speaker ring according to the present invention.
Figure 4:
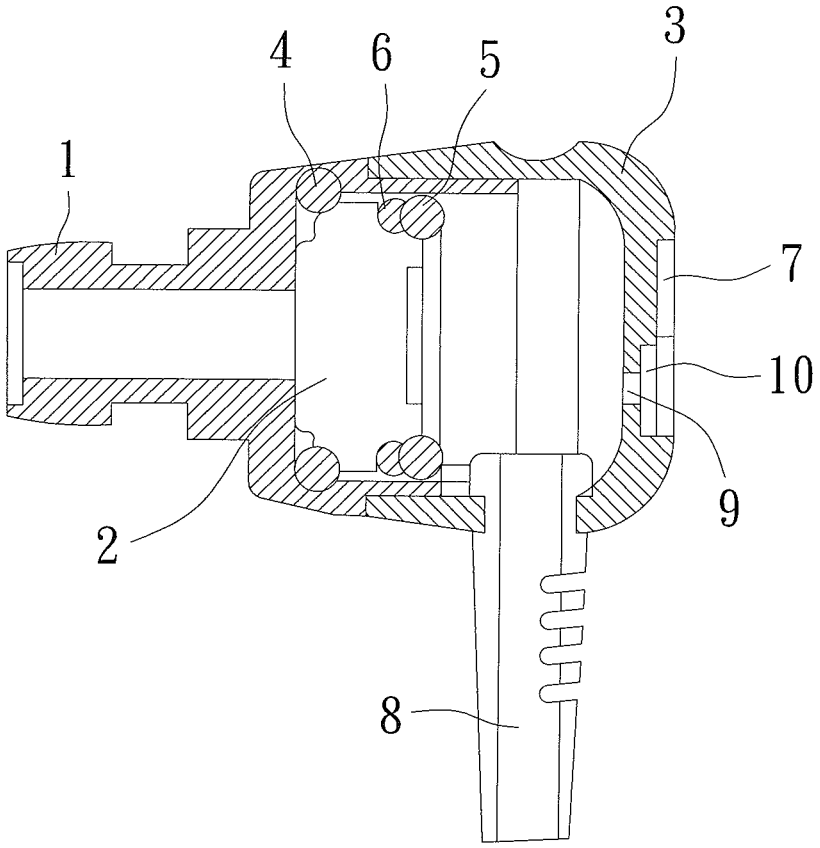
FIG. 4 is a cross sectional view showing the assembly of a part of the earphone with the speaker ring according to the present invention.
Figure 5:
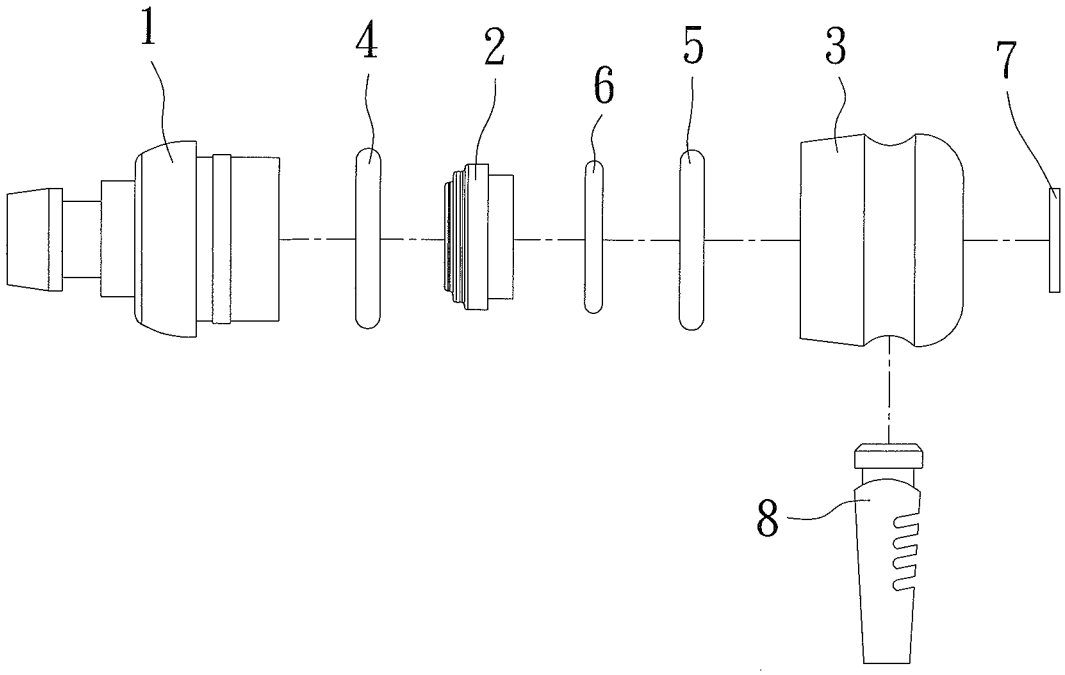
FIG. 5 is a front plan view showing the exploded components of the earphone with the speaker ring according to the present invention.
Figure 6:
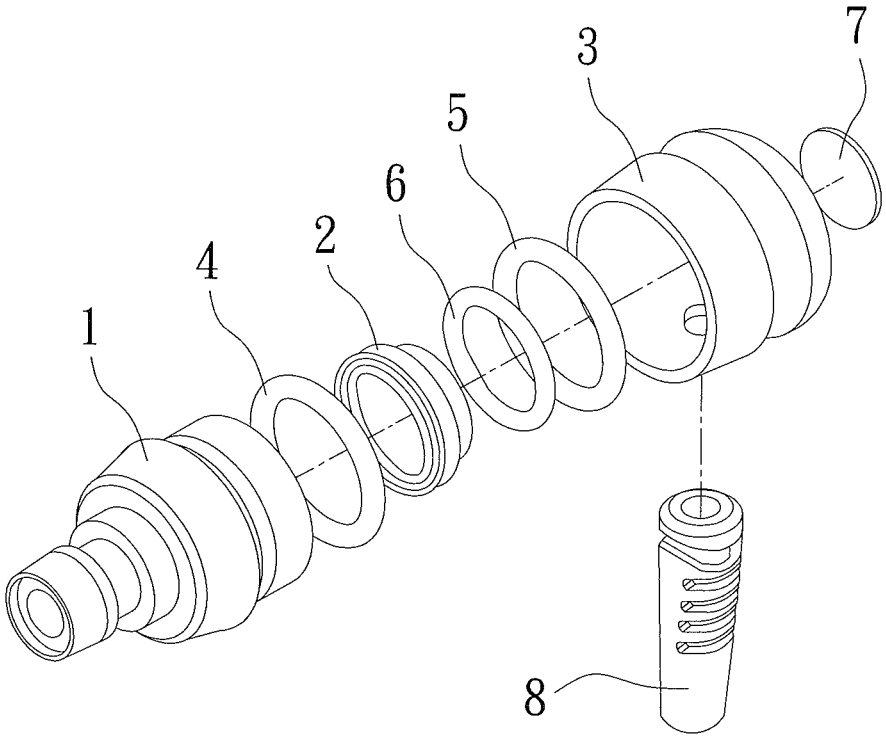
FIG. 6 is a perspective view showing the exploded components of the earphone with the speaker ring according to the present invention.
Figure 7:
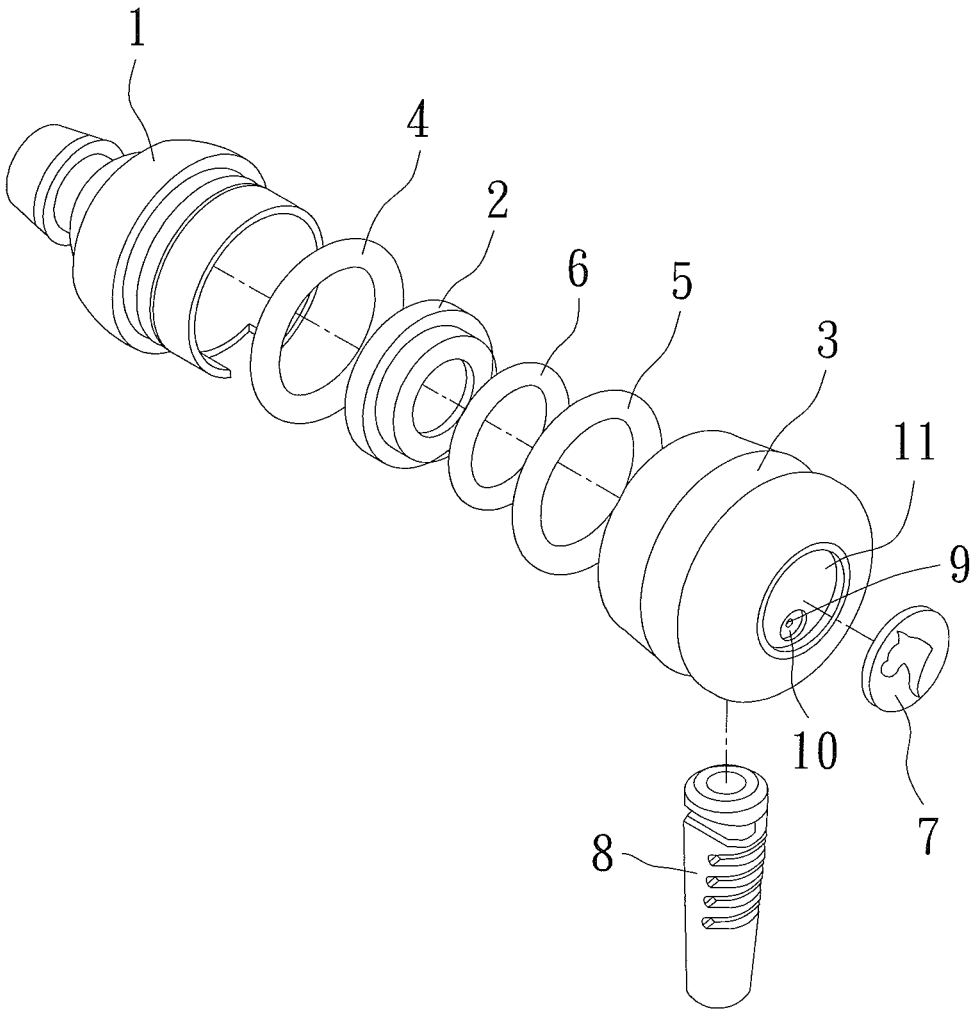
FIG. 7 is another perspective view showing the exploded components of the earphone with the speaker ring according to the present invention.

The present invention will be clearer from the following description when viewed together with the accompanying drawings, which show, for purpose of illustration only, preferred embodiments in accordance with the present invention.

With reference to FIGS. 1 to 7, an earphone with a speaker ring according to a preferred embodiment of the present invention comprises: a sound guiding tube 1, a speaker 2, and a body 3. The sound guiding tube 1 is connected with the body 3 to form an earphone, and the speaker 2 is disposed in the sound guiding tube 1. In this embodiment, the speaker 2 has a first O ring 4 fitted on a front end thereof and a second O ring 5 fitted on a rear end thereof, and the first O ring 4 and the second O ring 5 are defined between the speaker 2 and the sound guiding tube 1 to prevent the speaker 2 from resonance with the sound guiding tube 1 in use. In this embodiment, a third O ring 6 is fitted between the second O ring 5 and the speaker 2 based on the using requirement. In addition, a diameter of each of the first O ring 4 and the second O ring 5 is 7 mm, a diameter of a cross section of each of the first O ring 4 and the second O ring 5 is 1.5 mm, a diameter of the third O ring 6 is 7 mm, and a diameter of a cross section of the third O ring 6 is 1.1 mm. Preferably, a size of each of the first O ring 4, the second O ring 5, and the third O ring 6 is configured according to the using requirement.

The body 3 includes an air orifice 9 defined on a rear end thereof, such that when the speaker 2 vibrates in a closed space, air discharges or draws through the air orifice 9 to reduce resistance of the air against the speaker 2. The air orifice 9 is embodied in following embodiments.

Figure 8:
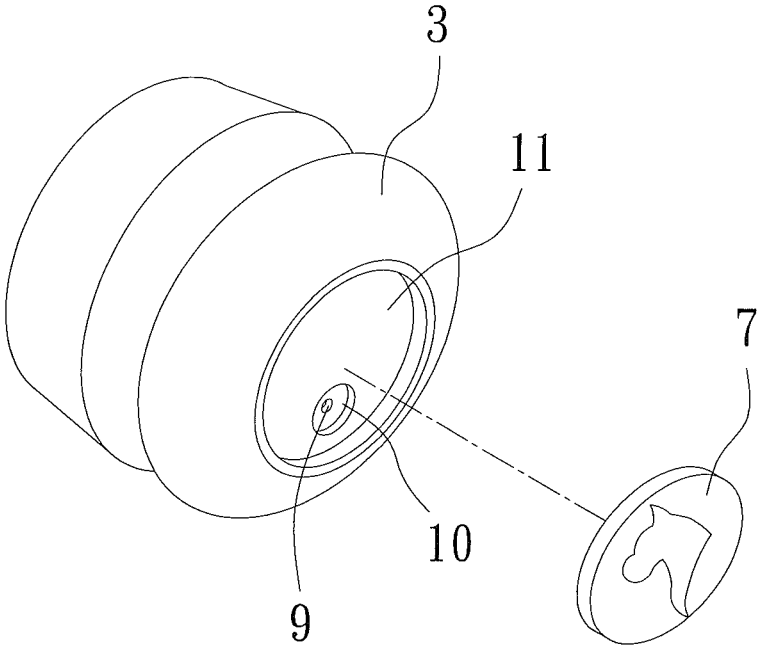
FIG. 8 is a perspective view showing the assembly of a body of the earphone with the speaker ring according to a first embodiment of the present invention.

In a first embodiment, as shown in FIG. 8, a diameter of a nameplate groove 11 of the body 3 is 6.5 mm and a depth is 0.5 mm, and the nameplate groove 11 has a slot 10 with a diameter of 3 mm and a depth of 0.5 mm. The slot 10 has the air orifice 9 with a diameter of 1.0 mm. The nameplate groove

11 has a nameplate 7 accommodated therein to shield the air orifice 9.

Figure 9:
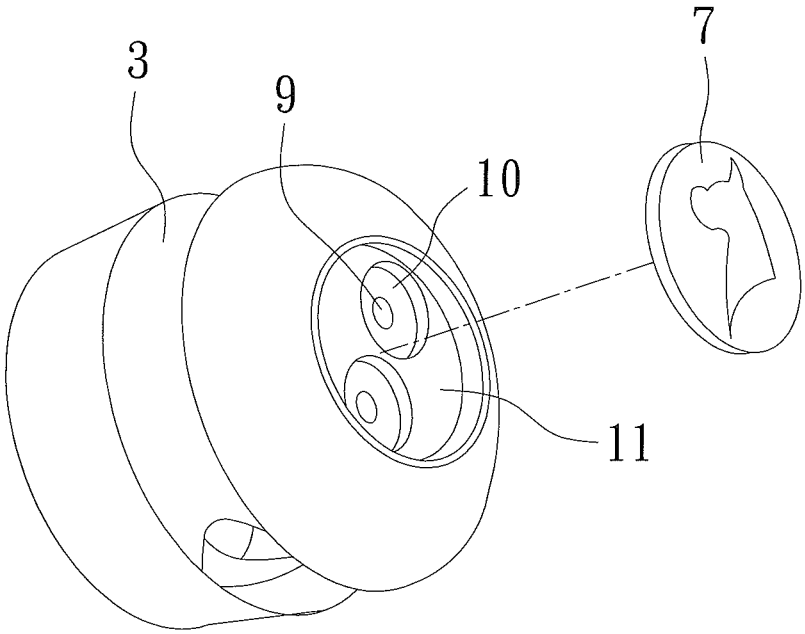
FIG. 9 is a perspective view showing the assembly of a body of the earphone with the speaker ring according to a second embodiment of the present invention.

In a second embodiment, as shown in FIG. 9, a diameter of a nameplate groove 11 of the body 3 is 6.5 mm and a depth is 0.5 mm, and the nameplate groove 11 has two slots 10, each with a diameter of 3 mm and a depth of 0.5 mm. Each slot 10 has the air orifice 9 with a diameter of 1.0 mm, such that two air orifices 9 are formed on the two slots 10. The nameplate groove 11 has a nameplate 7 accommodated therein to shield the two air orifices 9.

Figure 10:
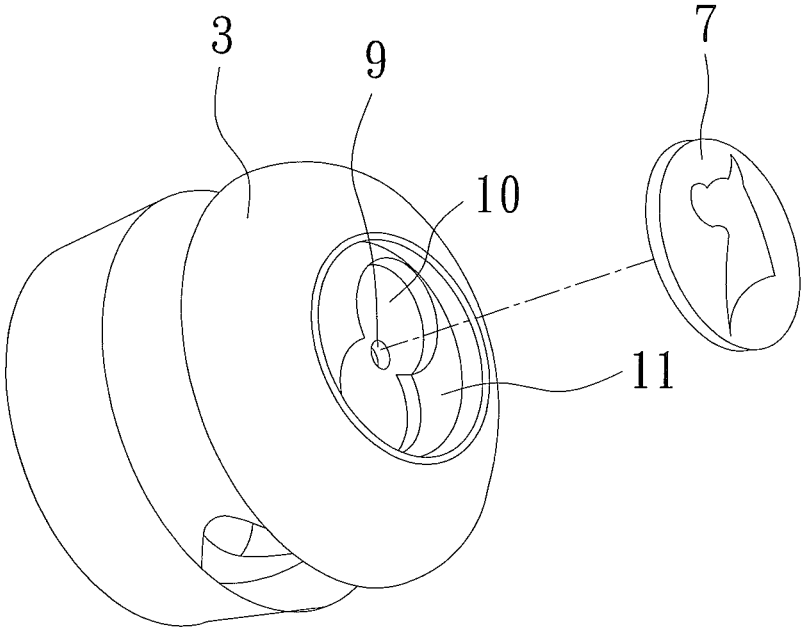
FIG. 10 is a perspective view showing the assembly of a body of the earphone with the speaker ring according to a third embodiment of the present invention.

In a third embodiment, as shown in FIG. 10, a diameter of a nameplate groove 11 of the body 3 is 6.5 mm and a depth is 0.5 mm, and the nameplate groove 11 has two slots 10, each with a diameter of 3 mm and a depth of 0.5 mm. Each slot 10 has the air orifice 9 with a diameter of 1.0 mm, and the two slots 10 are partially crossed to form a 8 shape. The air orifice 9 is defined on an intermediate position of the two slots 10 and has a diameter of 1.0 mm. The nameplate groove 11 has a nameplate 7 accommodated therein to shield two air orifices 9.

The body 3 also includes a protective sleeve 8 for protecting a connecting wire of the earphone.

In above three embodiments, the earphone is applicable for a user's right ear. Since other mechanisms of the earphone are a well-known art, further remarks are omitted.

Thereby, the first O ring, the second O ring, and the third O ring are arranged between the speaker and the sound guiding tube to reduce the resistance between the speaker and the sound guiding tube, thus increasing tone quality.

While various embodiments in accordance with the present invention have been shown and described, it is clear to those skilled in the art that further embodiments may be made without departing from the scope of the present invention.

What is claimed is:

1. An earphone with a speaker ring comprising:

a sound guiding tube;

a speaker; and a body, with the sound guiding tube being connected with the body, with the speaker disposed in the sound guiding tube, wherein the speaker has a first O ring fitted on a front end thereof and a second O ring fitted on a rear end thereof, wherein the first O ring and the second O ring are defined between the speaker and the sound guiding tube, wherein the body includes a slot defined on a rear cap thereof, with the slot including at least one air orifice, wherein the slot has a nameplate groove arranged therearound, and wherein the nameplate groove has a nameplate accommodated therein.

2. The earphone with the speaker ring as claimed in claim 1, wherein an earphone comprises a third O ring fitted on the rear end of the speaker and inside the second O ring.

3. The earphone with the speaker ring as claimed in claim 2, wherein a diameter of a cross section of the third O ring is less than that of the second O ring.

4. The earphone with the speaker ring as claimed in claim 2, wherein a diameter of the third O ring is 7 mm, and wherein a diameter of a cross section of the third O ring is 1.1 mm.

5. The earphone with the speaker ring as claimed in claim 2, wherein a number of the at least one air orifice is one or two.

6. The earphone with the speaker ring as claimed in claim 1, wherein a diameter of each of the first O ring and the second O ring is 7 mm, and wherein a diameter of a cross section of each of the first O ring and the second O ring is 1.5 mm.

7. The earphone with the speaker ring as claimed in claim 6, wherein a number of the at least one air orifice is one or two.

8. The earphone with the speaker ring as claimed in claim 1, wherein a number of the at least one air orifice is one or two.

* * * * *